US005547002A

United States Patent [19]

Runnebaum

[11] Patent Number: 5,547,002

[45] Date of Patent: Aug. 20, 1996

[54] PRESS MACHINE

[76] Inventor: Larry J. Runnebaum, Beattie, Kans.

[21] Appl. No.: 467,736

[22] Filed: Jun. 6, 1995

[51] Int. Cl.[6] ..... B27G 1/00; B27G 1/02

[52] U.S. Cl. ..... 144/332; 29/798; 100/176; 144/330; 144/362; 144/49; 144/2.1

[58] Field of Search ..... 100/176, 913; 29/432, 714, 798; 144/2 R, 49, 256.1, 256.3, 330, 329, 332, 359, 361, 362

[56] References Cited

U.S. PATENT DOCUMENTS

| | | | |
|---|---|---|---|
| 3,419,205 | 12/1968 | Jureint et al. | 144/332 X |
| 4,489,874 | 12/1984 | Worst et al. | 144/2 R X |
| 5,111,861 | 5/1992 | Gore et al. | 144/2 R X |
| 5,207,046 | 5/1993 | Vekkeli . | |
| 5,375,315 | 12/1994 | Griffith et al. . | |
| 5,419,382 | 5/1995 | Thompson | 100/176 |

*Primary Examiner*—W. Donald Bray
*Attorney, Agent, or Firm*—Kokjer, Kircher, Bowman & Johnson

[57] ABSTRACT

A press machine having a frame with a central channel projecting along a length thereof. The channel slidably guides a piece of lumber along a processing path. Press wheels are mounted to longitudinal supports extending along opposite sides of the central channel. One of the longitudinal supports is pivotally mounted at one end to the frame with a corresponding press wheel rotatably mounted at an intermediate point along the support. The press wheels are oriented to rotate about parallel axes and in opposite directions with adjacent sides thereof overlapping opposite sides of the processing path. The press wheels are spaced apart from one another such that adjacent arcuate portions of each press wheel are located immediately adjacent the processing path to frictionally engage a leading end of a piece of lumber conveyed along the processing path. The press wheels pull the lumber therethrough while simultaneously inducing lateral pressure upon opposite sides of the lumber to flatten any foreign material projecting from the lumber. A hold down shoe is pivotally mounted to the frame and is located proximate the upstream end of the press wheels to slidably engage a piece of lumber as the lumber becomes wedged between the wheels. The shoe resists twisting of the lumber as the lumber is pulled through the wheels.

17 Claims, 4 Drawing Sheets

PRESS MACHINE

FIELD OF THE INVENTION

The present invention generally relates to a press machine for refurbishing lumber having foreign material projecting from edges thereof. In particular, the inventive machine presses the foreign material into the lumber to afford smooth sides along opposite edges of the lumber.

BACKGROUND OF THE INVENTION

Today, many industries which utilize lumber are concerned with escalating lumber prices. To reduce material costs, these industries are becoming increasingly interested in conserving materials through the use of reused or refurbished lumber which was previously used to build a permanent or temporary structure. Once the useful life of a structure expires, it is disassembled and the lumber therefrom is used elsewhere.

Typically, when lumber is disassembled from an existing structure, the lumber retains foreign material embedded therein and projecting therefrom, such as nails, wire, metallic fasteners and the like.

In the past, this foreign material was manually removed from the lumber, such as with a hammer or pry bar, prior to reusing the lumber. Alternatively, the foreign material was driven into the lumber with a hammer to afford a flush surface along the lumber. However, these past systems for repairing reusable lumber are extremely labor intensive and, heretofore, have proven not cost effective.

One exemplary industry, albeit not the only one, relates to the pallet industry for mass distribution of products packaged in large quantities. Throughout distribution and storage, these products are stored and transported upon pallets in bulk quantities. Each pallet is engaged by a forklift to move the produce upon the pallet. As is known, each pallet is formed with upper and lower decks formed of multiple pieces of lumber or particle board, aligned side by side and spaced slightly apart from one another. The upper and lower decks are separated by and nailed to upper and lower edges of stringers, such as two by fours. The stringers are arranged perpendicular to the top and bottom floors and are oriented on their edges to afford the maximum distance (approximately 4 inches) between the top and bottom decks. Typically, a pallet includes three stringers, two of which extend along opposite ends of the deck and one of which extends along the center of the deck.

As the pallets are used, they become worn with broken boards in the top and bottom decks. To conserve lumber, older broken pallets are dismantled and the unbroken deck boards are reused to build new pallets. Generally, pallets are disassembled upon conventionally known disassembling machines which include a conveying surface along which the pallet is driven. The disassembling machine includes multiple V-shaped tapered arms or wedges which are mounted upon the conveying surface and aligned parallel to the conveyance direction. The tapered arms are oriented with the apex of the V-shape directed toward the upstream end of the conveying surface. Each V-shaped wedge includes an outer tip which is received between the upper and lower decks of the pallet to be disassembled. Generally, pairs of tapered wedges are formed to receive stringers therebetween. As the pallet is driven along the conveying surface, the V-shaped wedge forces the upper and lower decks in opposite directions, thereby causing the upper and lower decks to be separated from the stringer immediately adjacent the wedge arms. This process is repeated for each stringer until the upper and lower decks are completely separated from one another and from the stringers. The resulting lumber includes individual top and bottom deck boards and individual stringers having nails projecting from but embedded in top and bottom edges thereof.

Heretofore, if the stringers were to be reused, it was necessary to manually drive each nail into the stringer with a hammer or pull it from the stringer. This process was unduly labor intensive and not cost effective.

A need remains within the reusable lumber industry for a machine capable of automatically refurbishing pieces of lumber having foreign material embedded therein to afford smooth edges along the lumber. The present invention is intended to meet this need.

SUMMARY OF THE INVENTION

It is an object of the present invention to provide an automated apparatus capable of refurbishing a piece of lumber to afford smooth edges along opposite sides of the lumber.

It is a further object of the present invention to provide a press machine for refurbishing used lumber which is automatically adjustable to receive lumber having differing shapes, contours and sizes.

It is a corollary object of the present invention to provide a press machine for refurbishing lumber having notches and recesses formed in the edges thereof.

These and other objects are achieved by the present invention which includes a press machine having a frame with a central channel projecting along a length thereof. The channel defines a processing path and guides a piece of lumber therealong. A pair of press wheels are rotatably mounted to longitudinal supports extending along opposite sides of the central channel. One of the supports is pivotally mounted at one end to the frame with a corresponding press wheel rotatably mounted at an intermediate point along the length of the support. The press wheels are oriented to rotate about parallel axes and in opposite directions with adjacent sides thereof overlapping opposite sides of the processing path. The press wheels are spaced apart from one another such that adjacent arcuate portions of each press wheel are located immediately adjacent the processing path to frictionally engage a leading end of a piece of lumber conveyed along the processing path. The press wheels pull the lumber therethrough while simultaneously inducing lateral pressure upon opposite sides of the lumber to flatten any foreign material projecting from the lumber. A hold down shoe is pivotally mounted to the frame and is located proximate the upstream end of the press wheels to slidably engage a piece of lumber as the lumber becomes wedged between the wheels. The shoe resists twisting of the lumber as the lumber is pulled through the wheels.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
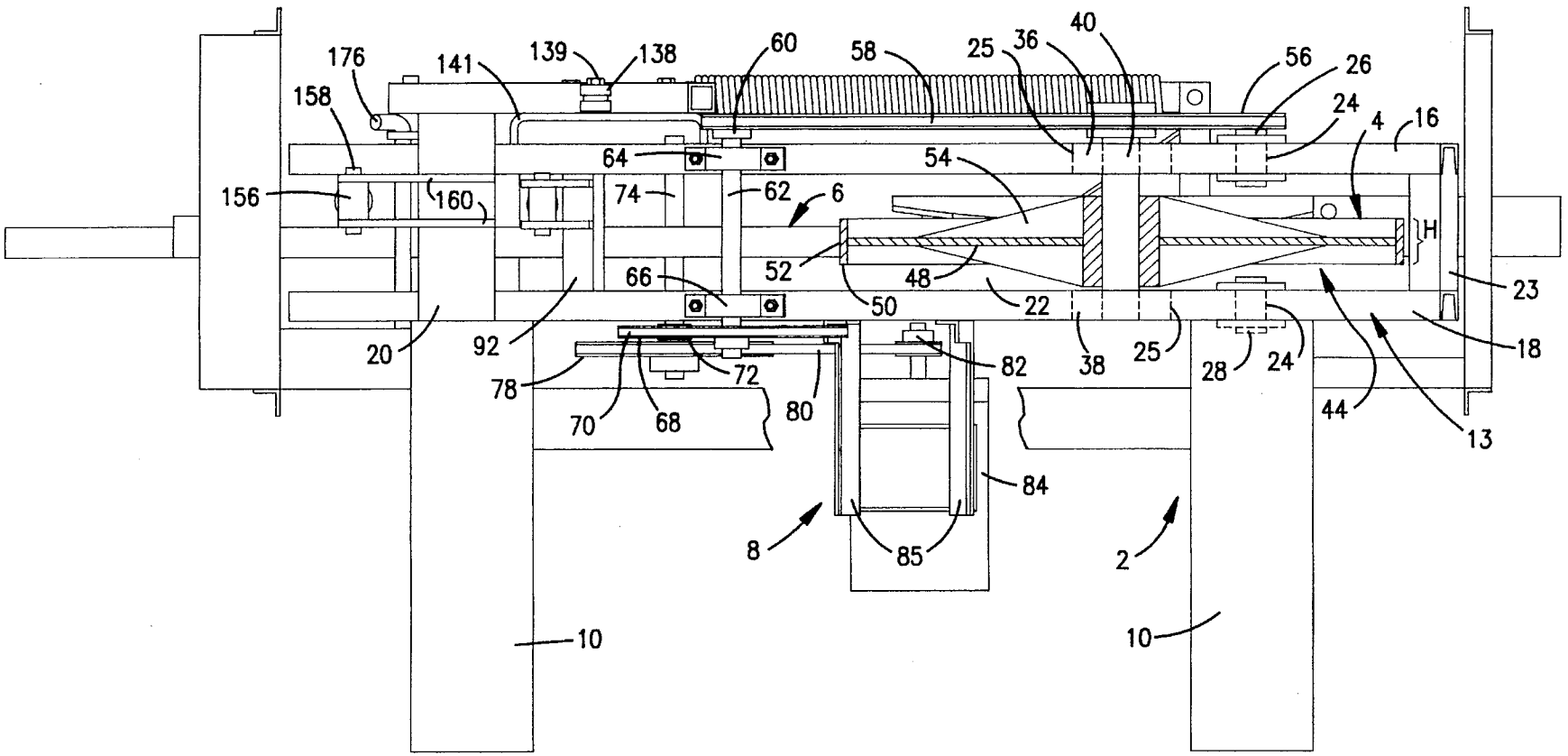
FIG. 1 illustrates a side view of a machine according to the present invention.

FIG. 1 illustrates a side view of the present invention which includes a frame 2 supporting press means 4 and lumber guiding means 6. The press means 4 is driven by drive means 8. As explained hereafter, the guide means 6 delivers a piece of lumber 1 along a processing path through the inventive apparatus. As the lumber 1 travels along this path, the press means 4 refurbish opposite sides 3 and 5 thereof by pressing any foreign objects 9 into the lumber 1 to present a smooth side for reuse.

Figure 2:
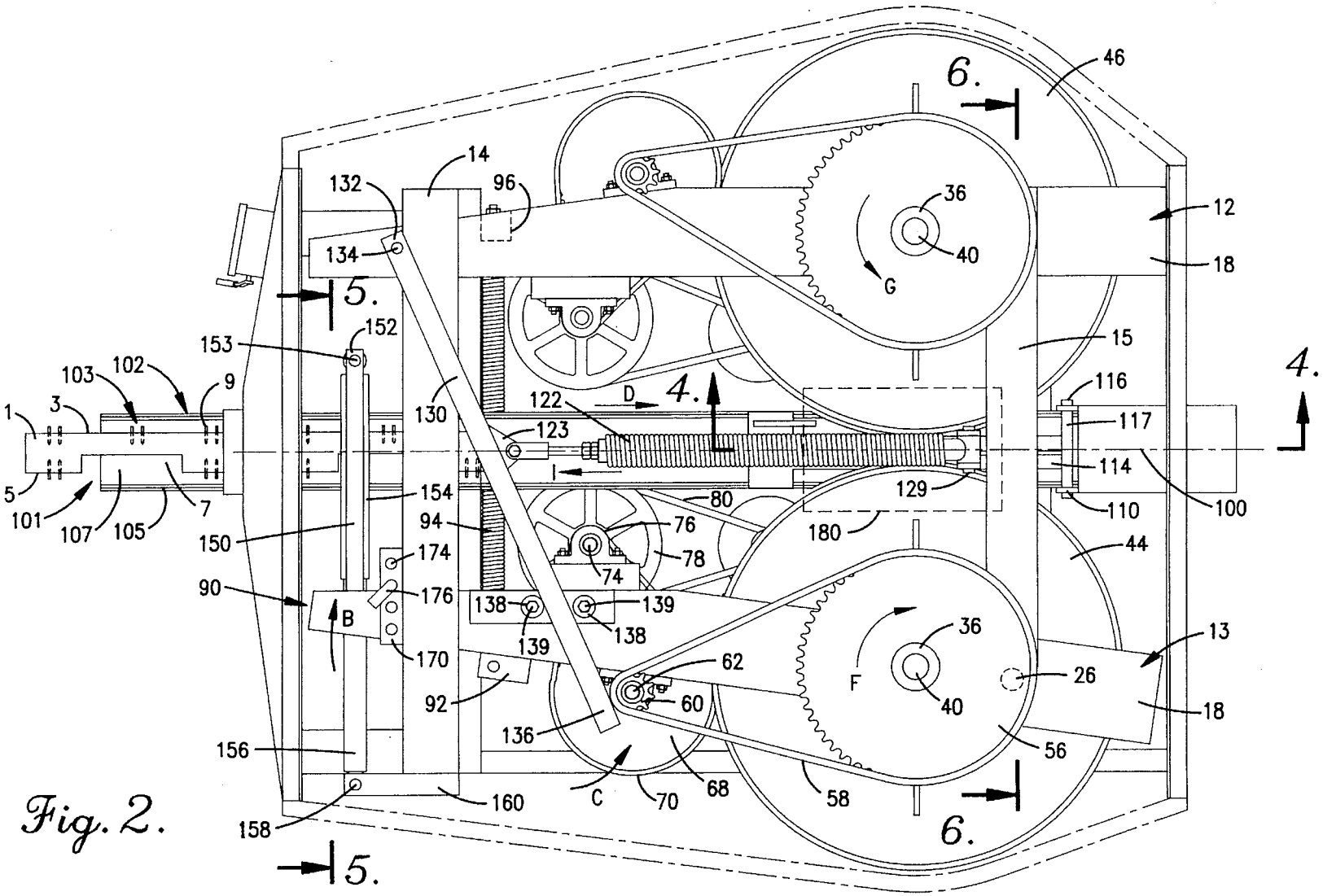
FIG. 2 illustrates a top plan view of a machine according to the present invention while in a disengaged position.
Figure 5:
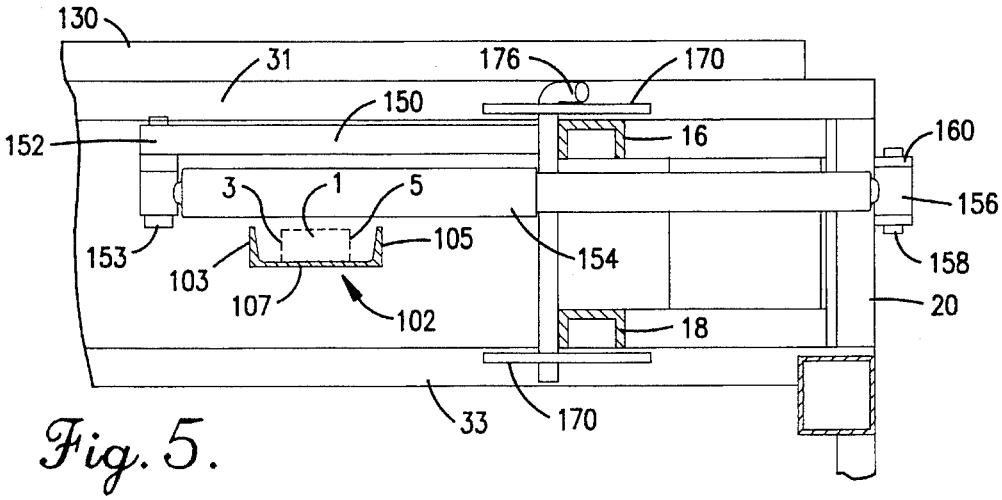
FIG. 5 illustrates a front end sectional view taken along line 5—5 in FIG. 2 of the present invention.
Figure 6:
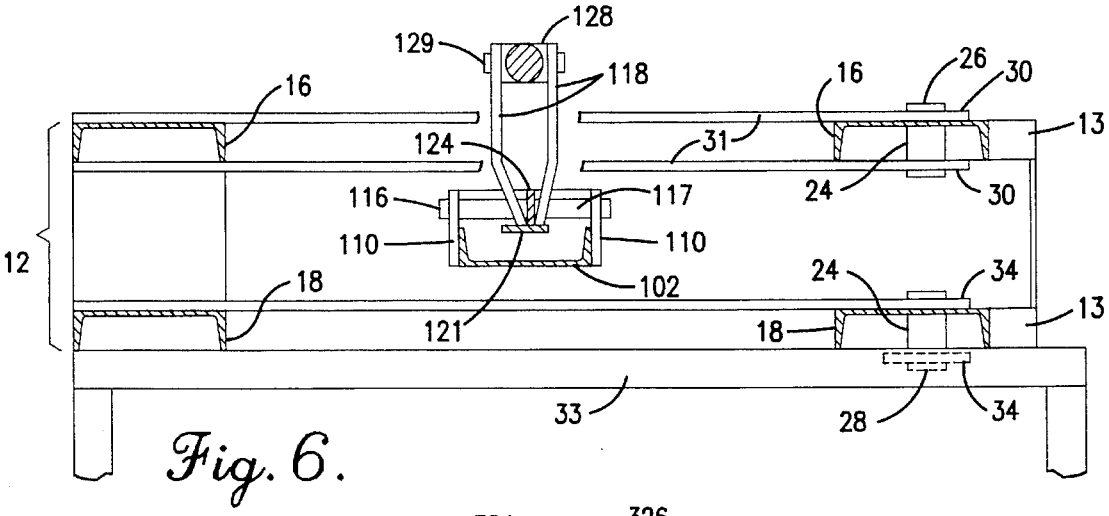
FIG. 6 illustrates a rear end sectional view taken along line 6—6 in FIG. 2 of the present invention.

The frame 2 includes legs 10 mounted to stationary and pivotal longitudinal supports 12 and 13 (FIG. 2), and front and rear lateral supports 14 and 15 (FIG. 2). As illustrated in FIG. 1, the longitudinal support arms 12 and 13 comprise upper and lower support beams 16 and 18, respectively, mounted in a fixed relation to one another via vertical end brackets 20, 92 and 23. The lateral supports 14 and 15 (FIG. 2) include upper and lower support beams 31 and 33 (FIGS. 5 and 6) secured to the frame 2 and to one another via vertical braces 35 (FIGS. 5 and 6). The upper and lower support beams 31 and 33 extend parallel to one another and are fixedly secured, at one end, to upper and lower support beams 16 and 18 in the stationary support arm 12. The front set of support beams 31 and 33 in the front lateral support 14 are not affixed to, but instead slidably support, the forward ends of the support beams 16 and 18 of the pivoting longitudinal support arm 13. The rear set of support beams 31 and 33 in the rear lateral support 15 include flanges 30 and 34 (FIG. 6) which pivotally support the pivoting longitudinal support arm 13.

The support beams 16 and 18 of the stationary and pivotal supports 12 and 13 extend along a horizontal plane, in the preferred embodiment, and parallel to one another with each pair of beams 16 and 18 forming a working space 22 therebetween. The stationary longitudinal support 12 is rigidly mounted to the frame at opposite ends. The pivoting longitudinal support arm 13 includes holes 24 through the upper and lower support beams 16 and 18 proximate the rear or pivoting end thereof. The holes 24 pivotally receive upper and lower shafts 26 and 28 which extend through corresponding holes 24 and through flanges 30 and 34 (FIG. 6) in the outer ends of the rear lateral support 15. The pivoting longitudinal support arm 13 pivots along a horizontal plane about the pivotal axis defined by the shafts 26 and 28.

The longitudinal supports 12 and 13 include intermediate holes 25 (FIG. 1) therethrough which receive bearings 36 and 38 which rotatably support shafts 40 extending along a vertical axes through the bearings 36 and 38. The shafts 40 rotatably support press wheels 44 and 46 (FIG. 2) which are fixedly mounted to the shafts 40.

As illustrated in FIG. 1, each press wheel 44 and 46 may be constructed with a flat disk-shaped circular core 48 having a flat lateral ring 50 mounted thereon to present a flat exterior surface 52 about a perimeter of each wheel. The ring 50 is formed to present a surface 52 having a height H at least equal to the height of a piece of lumber to be refurbished. As explained below, the surface 52 exerts substantial pressing forces upon the sides of a piece of lumber in order to flatten any foreign objects protruding from the sides of the lumber. Optionally, additional support flanges 54 may be mounted to the core 48 to further enhance its structural integrity.

As illustrated in FIG. 1, each shaft 40 projects upward beyond the press wheel 44 to receive a drive gear 56 (FIG. 2) fixedly thereon. The drive gear 56 is driven by a chain 58 which is in turn driven by a sprocket 60 mounted on a linkage shaft 62. The linkage shaft 62 is oriented to rotate about an axis aligned substantially parallel to the rotational axis of the press wheels 44. The linkage shaft 62 (FIG. 1) is rotatably mounted at opposite ends thereof, to the upper and lower support beams 16 and 18 via bearings and brackets 64 and 66. The sprocket 60 is mounted on the upper end of the shaft 62, while a gear 68 is mounted on the opposite end. The gear 68 is driven by a chain 70 which is in turn driven by a sprocket 72 (FIG. 5) mounted upon a second linkage shaft 74 (FIG. 1). The second linkage shaft 74 is mounted to the inner side of the upper and lower support beams 16 and 18 via bearings 76 (FIG. 2). The shaft 74 further receives a pulley 78 mounted thereon which is driven by a belt 80 that is in turn powered by a pulley 82 (FIG. 1) mounted to a motor 84. The motor 84 is fixedly mounted via a bracket 85 to the lower support beam 18, in order that the entire drive assembly moves with the pivoting longitudinal support arm 13. A duplicate drive assembly may be mounted upon the stationary longitudinal support arm 12.

The foregoing drive assembly represents the drive means which drive the press wheels 44 and 46 in the direction of arrows F and G, respectively. The preferred embodiment utilizes the disclosed gear and pulley arrangement to achieve the desired gear reduction from a motor having a high RPM speed in order to reduce this speed to the desired rotational rate for the press wheel However, it is to be understood that any variation of pulleys and/or sprockets, in number and in size, may be utilized to drive the press wheel 44. In fact, if a low RPM motor is utilized, such a motor may be directly mounted to the shaft 40 which drives the press wheel 44, thereby totally avoiding the use of belts and pulleys. It is also to be understood that any type of power source may be utilized to drive the press wheel, including electric, hydraulic and the like. While the preferred embodiment illustrates separate motors for each press wheel, it is to be understood that a single motor may be utilized to drive both press wheels, thereby ensuring synchronous rotation of the press wheels.

Returning to FIG. 2, the pivoting support arm 13 further includes a bracket 92 mounted on its outer side proximate the lead end 90 and extending between the upper and lower beams 16 and 18 (FIG. 1). The bracket 92 is secured to one end of a spring 94 (FIG. 2) which extends laterally across the frame and is secured at the opposite end to a bracket 96 securely mounted between the upper and lower beams 16 and 18 of the stationary support arm 12. The spring 94 biases the pivotal support arm 13 toward a processing path 100 extending along the longitudinal axis of the frame. In this manner, the spring 94 biases the press wheel 44 toward the press wheel 46 to an innermost position as illustrated in FIG. 2.

A guide chute 102, having a U-shaped cross-section is mounted horizontally upon the frame 12 and extends along the processing path 100. The chute 102 intersects the adjoining surfaces of the press wheels 44 and 46 at a tangential angle. The chute 102 defines the processing path 100. The chute 102 is constructed with sides 103 and 105 intersecting a base 107 (FIG. 5). The chute 102 includes half-moon shaped recesses 104 and 106 (FIG. 3) notched in the sides 103 and 105 and base 107 proximate the discharge end 108. The recesses 104 and 106 are formed with an arcuate contour substantially corresponding to the outer contour of the press wheels 44 and 46. The recesses 104 and 106 align with and receive corresponding arcuate portions of the press wheels 44 and 46. When a piece of lumber is guided along the chute 102, the chute 102 directs the lumber into an engaging relation with the portion of the exterior surfaces 52 of the press wheels 44 and 46 received within the recesses 104 and 106.

Figure 4:
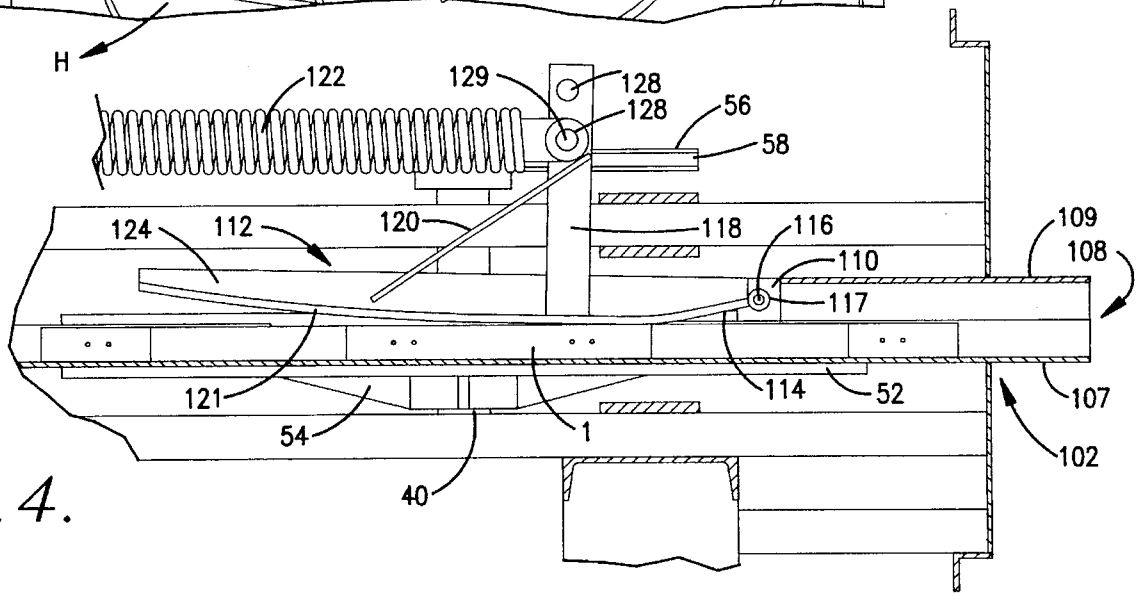
FIG. 4 illustrates a side sectional view taken along line 4—4 in FIG. 2 showing the hold down assembly in detail when engaged with a piece of lumber.

Turning to FIG. 4, the chute 102 further receives a ceiling channel member 109 having a U-shaped cross-section, which is directed downward and secured onto the sides 103 and 105 proximate the discharge end 108. Vertical brackets 110 are secured to the sides 103 and 105 and the upstream or forward end of the channel 109. The vertical brackets 110 include aligned holes which receive a pin 116 to form a hinge point.

As shown in FIG. 4, the pin 116 pivotally supports a hold down shoe 112. The hold down shoe 112 includes an arcuately shaped base section 121 extending from the front to the rear of the shoe 112. The rear end 114 of the base 121 includes a tubular hinge sheath 117 extending laterally across and fixedly mounted to the rear end 114 of the base 121. The sheath 117 is hollow to receive the pivot pin 116. The sheath 117 and pin 116 are hingably mounted within the holes through the vertical brackets 110 to afford a pivot axis transverse to the processing path about which the shoe 112 rotates. The base 121 further includes a support flange 124 extending along its longitudinal axis and projecting upward therefrom. The support flange 124 fixedly receives a pair of support brackets on opposite sides thereof defining a control arm 118. The control arm 118 projects upward from the base 121 and flanges 124. The control arm 118 includes a plurality of hole pairs 128 extending therethrough. One of the hole pairs 128 receives a pin 129 to secure the control arm 118 to one end of a spring 122. The control arm 118 may be further attached to the base 121 via a crossbar 120 for added support.

The spring 122 extends along the longitudinal axis of the chute 102 (FIG. 2). The spring 122 has one end pivotally attached to the control arm 118 and an opposition end pivotally attached to a flange 123 secured to one side of a crossbar 130 (FIG. 2). The crossbar 130 includes one end 132 pivotally mounted to the forward end of the stationary support arm 12 at a hinge point 134. The crossbar 130 extends across a width of the frame 12 and is slidably received, at the outer end 136 between a pair of guide rollers 138. The guide rollers 138 are rotatably supported by shafts 139 mounted at an intermediate point upon a bracket 141 (FIG. 1) on the pivotal support arm 13 and project upward from the upper support beam 16 thereof.

Figure 3:
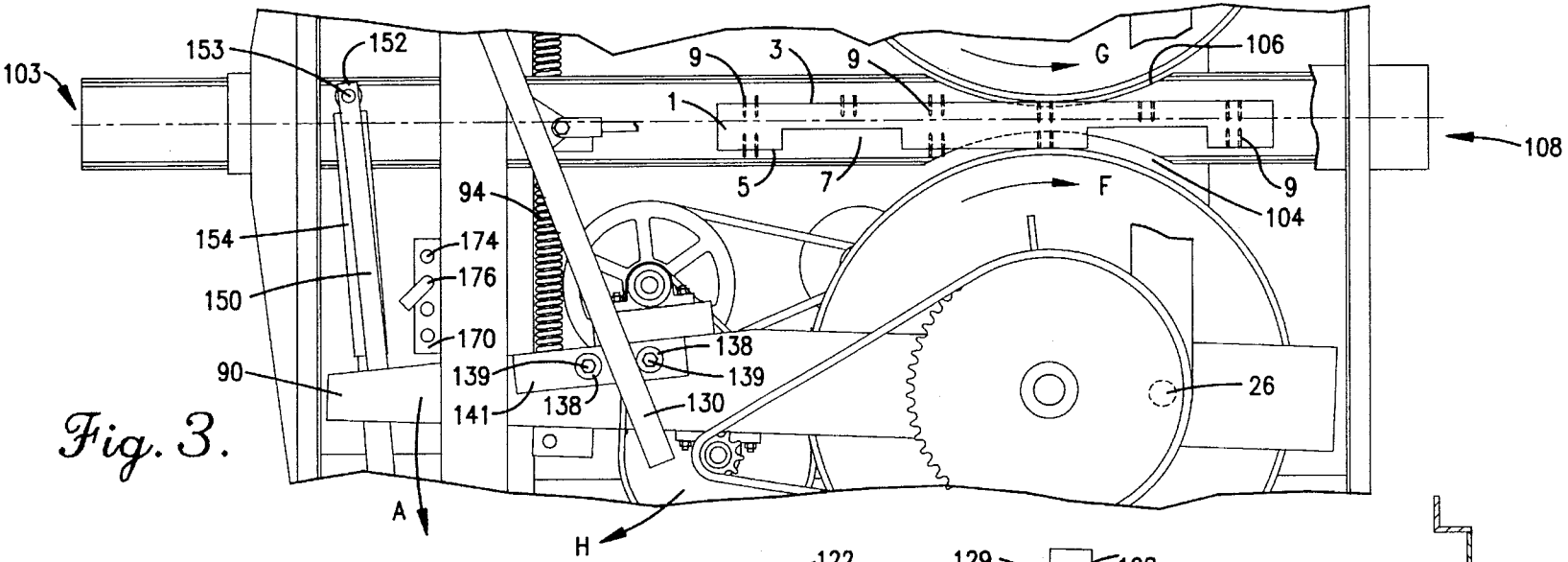
FIG. 3 illustrates a top plan view of a machine according to the present invention while in an engaged position and with the lumber hold down assembly removed.

As shown in FIGS. 3 and 5, optionally, the outer end 90 of the upper beam 16 in the pivoting support arm 13 includes an extension arm 150 mounted thereon and extending transversely across the frame 12. The extension arm 150 includes an outer end 152 which is secured via a hinge pin 153 to a shock absorber 154. The shock absorber 154 extends along and is aligned substantially parallel to the extension arm 150. The shock absorber 154 projects outward from the pivoting support arm 13 and includes an outer end 156 which is secured to a bracket 160 (FIG. 2) at a point 158. The bracket 160 is secured to the front lateral support 14 and projects forward therefrom to pivotally receive the outer end 156 of the shock absorber 154. The shock absorber 154, arm 150 and bracket 154 may optionally be used to retard movement of the pivoting support arm 13.

As shown in FIG. 5, optionally, the front lateral support 14 includes upper and lower brackets 170 and 172 extending laterally above and below the outer end 90 of the pivoting support arm 13. The upper and lower brackets 170 and 172 extend along the path of travel of the pivoting support arm 13. The brackets 170 and 172 include holes 174 therethrough which receive a pin 176 extending downward therethrough and traversing the path of travel of the pivoting support arm 13. The pin 176 defines the innermost stopping point of the pivoting support arm 13 in the direction of arrow B. By moving the pin 176 within different pairs of holes 174, the resting point of the pivoting support arm 13 is adjusted, thereby adjusting the minimum spacing between the press wheels 44 and 46.

Operation of the present invention will now be explained in connection with FIG. 2. Initially, prior to inserting lumber into the guide chute 102 at its entrance end 101, the spring 94 biases the pivoting support arm 13 in the direction of arrow B toward the stationary support arm 12. When biased in this manner, the press wheels 44 and 46 are located immediately adjacent one another within a pressing region (generally designated within the shadow box 180). When biased to this initial position, the press wheels 44 and 46 are received completely within the recesses 104 and 106 in the chute 102. At this initial stage, the crossbar 130 is pivoted about point 134 in the direction of arrow C to its rearmost starting position. The roller guides 138 move with the pivoting support arm 13 in the direction of arrow B to drive the crossbar 130 in the direction of arrow C. While the crossbar 130 is rotated to its rearward starting position, the spring 122 is similarly driven rearward in the direction of arrow D, thereby acting upon the control arm 118 to cause the shoe 112 to pivot upward about the pivot point 116. When disposed in this position, the forward end of the shoe 112 is located remotely from the base 107 of the chute by a distance greater than the maximum height of any lumber to be accepted.

Thereafter, a piece of lumber is inserted at the entrance end 101 of the chute 102 and slid along the processing path 100 until the forwardmost end of the lumber is guided by the chute 102 into a wedged position between the press wheels 44 and 46. Throughout operation, the press wheels 44 and 46 are rotated in the directions indicated by arrows F and G (FIG. 2). Thus, when the leading edge of the lumber engages the press wheels 44 and 46 proximate the pressing station 180, outer surfaces 52 of each press wheel frictionally engage opposite sides of the lumber to pull the lumber between the press wheels. As the lumber passes between the press wheels, it exerts lateral forces upon the press wheels. These lateral forces bias the pivotal press wheel 44 outward about the pins 26 and 28 in the direction of arrow A (see FIG. 3). The amount of lateral force which must be exerted upon the press wheel 44 to effect pivotal motion of the pivoting support arm 13 is dictated by the biasing tension within the spring 94. Thus, the spring 94 sets the amount of pressure exerted by the wheels 44 and 46 upon the lumber as it passes therebetween.

Once a piece of lumber effects pivotal movement of the support arm 13 about the pins 26 and 28, the forward end 90 of the support arm 13 similarly moves in the direction of arrow A. As the outer end 90 pivots, the guide rollers 138 (fixedly mounted thereon) are similarly moved laterally outward along this arcuate path. Such arcuate movement of the rollers 138 in turn forces the crossbar 130 to hinge about the pivot point 134 in the direction of arrow H (FIG. 3). As the crossbar 130 rotates forward in this manner, it similarly applies tension to the spring 122 (FIG. 2) connected at an intermediate point along the crossbar 130. Thus, forward movement of the crossbar 130 effects forward movement of the spring 122 in the direction of arrow I (FIG. 2).

As the spring 122 is biased forward, it similarly acts upon the control arm 118 to effect downward movement of the shoe 112 about the hinge pin 116. The shoe 112 pivots downward until it engages the upper side of the lumber 1 (as shown in FIG. 4). In this manner, the shoe 112 securely engages the upper side of the lumber 1, thereby sandwiching the lumber between the shoe 112 and the base 107 of the chute 102. Hence, the shoe 112 prevents the lumber from twisting and pivoting about its longitudinal axis as the lumber 1 is subject to the significant pressing forces exerted upon its opposite sides 3 and 5 (FIG. 2) by the press wheels 44 and 46. The amount of downward force exerted upon the lumber by the shoe 112 is dictated by the tension within the spring 122 which is adjusted by varying the connection within holes 128 between the spring 122 and control arm 118.

The shoe 112 is maintained in this engaging relation with the lumber 1 until the lumber 1 completely passes through the press wheels and is exhausted from the discharge end 108. The frictional forces upon opposite sides of the lumber exerted by the press wheels 44 and 46 act to pull the lumber through the pressing station 180 and discharge same from the opposite end. Once the lumber is discharged from the pressing station 180, the press wheel 44 is allowed to pivot inward in the direction of arrow B (FIG. 2) to its initial starting point. Again, the spring 94 acts to pivot the support arm 13 in this manner. As the support arm 13 pivots inward, the guide rollers 138 are similarly moved in the same direction, thereby acting upon the crossbar 130 to effect pivotal movement of the crossbar 130 in the direction of arrow C (FIG. 2). As the crossbar 130 pivots towards it resting position, it similarly allows the spring 122 to contract (by moving in the direction of arrow D). As the spring 122 is contracted, it acts upon the control arm 118 to cause the shoe 112 to pivot upward about the hinge pin 116 to the starting position. Once the shoe 112 is pivoted upward, it is again ready to receive a new piece of lumber.

As can be seen from the foregoing process, the shoe 112 is capable of accepting lumber of differing heights. Similarly, the press wheels 44 and 46 are capable of accepting lumber of differing widths. As is equally apparent, the press wheels 44 and 46 are capable of effecting the pressing operation over an uneven surface, such as upon boards 1 having notches 7 (FIG. 2) therein. The press wheels act to flatten foreign objects 9, such as nails. The press wheels also drive the foreign objects into the lumber to provide a flat smooth surface for reuse. In the preferred embodiment, the press wheels 44 and 46 are constructed with sufficient diameter to span the largest notches 7 expected to be encountered in a board. Utilizing press wheels with this diameter affords smooth feeding of lumber through the pressing station.

Optionally, smaller or larger press wheels may be utilized. Optionally, multiple press wheels may be located along both sides of the lumber. Optionally, one or more press wheels may be located upon each side and mounted upon a support other than a pivoting support arm. For instance, the press wheels may be mounted to slide along stationary lateral supports directed transverse to the processing path 100. The press wheels may be aligned and attached to springs to be biased along a transverse sliding axis defined along the length of the lateral supports. The press wheels may be driven to a board engaging position via a hydraulic source. The spring-type biasing means may be omitted and hydraulic cylinders substituted therefor. Optionally, the hydraulic and spring means may be used in combination.

Optionally, electrical and optical sensors may be added along the processing path 100 to sense the position of the board. The sensors would in turn direct hydraulic or electric power sources to drive the hold down shoe and press wheels into engaging relation with the lumber once it reaches the press station 180.

Optionally, the foregoing invention may be aligned with the press wheels extending along a horizontal plane, a vertical plane, or any orientation therebetween. Optionally, the inventive apparatus may be attached to the discharge end of a conventional pallet disassembly machine, which is used to separate stringer type lumber from upper and lower decks of pallets. In such an embodiment, the inventive apparatus may be aligned with the press wheels extending vertically along a vertical plane in order to act upon upper and lower edges of a stringer immediately after the stringer is separated from upper and lower decks of a pallet. A conveyor belt or rollers may deliver the stringer from the disassembler to the press machine.

Optionally, a flat strap 200 (FIG. 7) may be provided across the upper surface of the chute 102 proximate the upstream end of the press wheels 44 and 46 and the outer tip of the hold down shoe 112. The cross strap 200 supports a guide bar 202 extending rearward therefrom along at least one side of the shoe 112. The bar 202 guides the lumber into the press wheels 44 and 46 prior to engagement between the shoe 112 and the lumber 1. The bar 202 minimizes the allowed amount of twisting of the lumber prior to engagement by the shoe 112.

As illustrated in FIG. 2, the stationary longitudinal support arm 12 is securely fastened at opposite ends to the frame 12. Optionally, the stationary longitudinal support arm 12 may be modified to become a pivoting longitudinal support substantially resembling the support arm 13. In this alternative embodiment, both sides of the inventive mechanism may include pivoting supports to enable both press wheels to move relative to the processing path.

Figure 7:
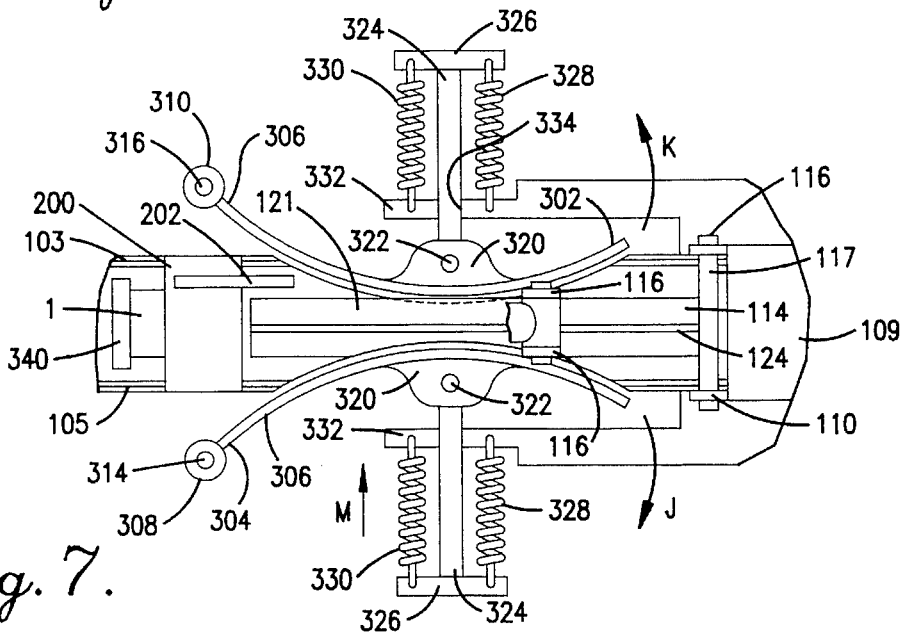
FIG. 7 illustrates a top plan view of an alternative embodiment the pressing station with press plates substituted for the press wheels.

As a further option, as illustrated in FIG. 7, the press wheels may be removed and half-moon or funnel shaped press plates 300 and 302 substituted therefore. The plates 300 and 302 may comprise flat metal straps (shown on edge in FIG. 7) curved along a desired radius with the flared ends being upstream of the pressing station. The straps are convex toward one another. Optionally, the straps may include a support flange (not shown) mounted to the back side thereof to provide additional support. The press plates 300 and 302 may be pivotally mounted at either end to the frame. In FIG. 7, the plates 300 and 302 include forward ends 304 and 306, respectively, having tubular vertical brackets 308 and 310 mounted thereto. The brackets 308 and 310 are pivotally mounted upon pins 312 and 314 which are securely affixed in a vertical alignment to the frame 2. The pins define a path of arcuate motion (as illustrated by arrows J and K in FIG. 7) along which one or both of the press plates may be pivoted. Optionally, one of the press plates 300 and 302 may be securely mounted at both ends to the frame 2 to provide a stationary plate.

The remaining structure of both brackets may be configured identically and thus only one is explained hereafter. At least one of the press plates 300 and 302 further include a drive bracket 320 mounted to the back side thereof proximate the point along the plate at which the plates are in closest proximity to one another. Optionally, the bracket 320 may be located at any point along the back side of the press plate 300, 302. The bracket 320 includes upper and lower halves extending parallel to one another and spaced apart from one another slightly to receive a forward end of a shaft 324 therebetween. The forward end of the shaft is secured to a pin 322 extending between the upper and lower halves of the bracket 320. The pin 322 and bracket 320 cooperate to provide a pivotal connection between the shaft 324 and the back side of the press plate 300. The shaft 324 extends rearward from the press plate 300 along a radius of the plate. The shaft 324 projects laterally outward and through a hole in a base bracket 332 which is fixedly mounted to the frame 2. The outer or rear end of the shaft 324 includes a T-shaped cross bar 326 mounted thereon and extending laterally therefrom in both directions (in FIG. 7 within a horizontal plane). The bar 326 includes hooks on inner sides thereof and on opposite sides of the shaft 324. The hooks securely retain one end of springs 328 and 330. Opposite ends of the springs are secured within corresponding hooks on the base bracket 332. The springs bias the shaft 324 in the direction of arrow M, namely inward toward the opposite press plate and the lumber 1. The tension upon the springs 328 and 330 may be varied to maintain a desired amount of inward tension upon the press plates 300 and 302. The shafts 324 and brackets 320 may be secured at any point along the rear surface of the press plate 300.

In the embodiment of FIG. 7, the press plates 300 and 302 do not pull the lumber therebetween. Instead, separate drive means are required to push or pull the lumber through the press plates. The drive means may include a conveyor belt with paddles 340 projecting upward therefrom. Each paddle 340 may engage a rear end or and intermediate notched section of a piece of lumber 1. The paddles 340 push the lumber 1 through the press plates. Alternatively, the hold down shoe may be removed and a plurality of drive rollers substituted therefor. The rollers may be aligned immediately adjacent to one another and mounted to rotate upon parallel rotational axes aligned transverse to the longitudinal axis of the chute 102. The rollers would project downward, in an end-to-end arrangement, immediately above the chute and in place of the hold down shoe 112. The rollers would be driven by a remote source and would engage the top surface of the lumber to force the lumber between the press plates 300 and 302. Optionally, a row of drive rollers may also be located along the bottom of the lumber 1.

Optionally, the shaft 324 or bar 326 may be connected to the cross bar 130 in the first embodiment to drive the hold down shoe against the lumber 1 at the desired time. Optionally a stationary shoe may be mounted to the top of the chute 102 where a predefined small range of lumber heights are being used.

Optionally, the lumber contacting surfaces of the press wheel and press plate may be constructed in a concave manner (or with a V-shaped cross-section) to receive the sides of the lumber within the concave portion thereof. The concave cross section securely grasps the lumber and prevents it from twisting and turning along its longitudinal axis. If the press wheels or press plates are configured to grasp the lumber in a manner which resist twisting of the lumber, the hold down shoe need not be used.

The press wheels and press plates align within the notches 104 and 106 to form an extrusion type tapered opening therebetween. Alternatively, the press plates may be slidably mounted on lateral supports and biased inward via springs, hydraulic cylinders and the like. Hydraulic cylinders driven by photo sensors may be substituted for the springs 328 and 330. Alternatively, hydraulic cylinders may drive the press plates inward responsive to magnetic field sensors. The sensors would be located immediately upstream of the pressing station and would detect the presence of metal objects embedded within the lumber. The sensor, upon detecting metal (i.e., a nail) within the lumber would activate the cylinders, thereby driving the press plates inward from an outwardly positioned stationary position. As the press plates were driven inward, the lumber engaging surfaces thereof would embed the metal within the lumber, to afford a smooth surface upon the lumber when discharged.

Optionally, one press wheel and one press plate may be used.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A press machine for refurbishing a piece of lumber having foreign material projecting from at least one side thereof to form smooth sides upon the lumber, said machine comprising:

a frame having a central channel projecting along a length thereof, said channel slidably guiding the lumber along a processing path;

at least a pair of press means, for pressing foreign material into sides of the lumber, said press means being mounted to said frame and aligned proximate one another and upon opposite sides of the processing path, said press means having adjacent arcuate portions spaced apart from one another by a distance less than a width of the lumber; and a power source for driving each piece of lumber between said press means.

2. A press machine according to claim 1, wherein said frame includes a pivoting arm hingably mounted at one end to the frame, to pivot between first and second positions, and at an opposite end to a biasing member which biases the pivoting arm to said first position, said pivoting arm supporting one of said press means at an intermediate point along said pivoting arm, said pivoting arm pivoting from said first position toward said second position to widen a space between said press means to frictionally accept the lumber therebetween.

3. A press machine, according to claim 1, wherein a first press means is pivotally and rotatably mounted to said frame, said first press means rotating about an axis to pull said lumber along the processing path.

4. A press machine, according to claim 1, further comprising:

a lumber engaging shoe mounted to the frame, said shoe being located proximate the channel and at a point along the processing path directly upstream of said press means, said shoe engaging the lumber to guide the lumber along a predefined path and to prevent the lumber from pivoting about its longitudinal axis.

5. A press machine, according to claim 4, wherein said shoe is pivotally mounted to the frame and includes means for rotating the shoe from a lumber nonengaging position to a lumber engaging position when a leading end of the lumber engages said press means.

6. A press machine, according to claim 1, further comprising:

means for engaging upper and lower surfaces of the lumber when a leading end thereof contacts the press means and for preventing the lumber from twisting about its longitudinal axis as the lumber is directed through the press means.

7. A press machine, according to claim 6, further comprising:

a lateral support pivotally mounted to said frame, for rotatably supporting a first press means; and a control arm, slidably engaging said lateral support and pivotally connected to said engaging means, said control arm forcing said engaging means against the lumber when said first press means engage the lumber.

8. A press machine, according to claim 1, further comprising support arms extending along opposite sides of the channel, said press means comprising press wheels, said support arms rotatably supporting corresponding press wheels, one of said support arms being pivotally mounted to said frame at a pivot point aligned to allow lateral movement between press wheels to admit the lumber therebetween.

9. A press machine, according to claim 1, wherein said press means includes at least one press wheel.

10. A press machine comprising:

a frame having a central channel extending along a length of said frame, said channel defining a processing path;

first engaging means for engaging opposite sides of the lumber and for inducing inward pressure upon opposite sides of the lumber sequentially along its length; and means for driving the lumber through said engaging means.

11. A press machine, according to claim 10, wherein said engaging means incudes at least one press wheel aligned to apply pressure against the lumber, said press wheel being rotatably driven by the drive means to pull the lumber along the processing path.

12. A press machine according to claim 10, wherein said frame includes a rocker arm hingably mounted to the frame to pivot between first and second positions, and to a biasing member which biases the rocker arm to said first position, said rocker arm supporting said first engaging means at an intermediate point along said rocker arm, said rocker arm pivoting from said first position toward said second position to frictionally accept the lumber within said first engaging means.

13. A press machine, according to claim 10, further comprising:

a lumber engaging shoe mounted to the frame, said shoe being located proximate the channel and at a point along the processing path directly upstream of said first engaging means, said shoe slidably engaging the lumber to guide the lumber along a predefined path, said shoe preventing the lumber from pivoting about a longitudinal axis thereof.

14. A press machine, according to claim 10, further comprising:

second engaging means for engaging upper and lower surfaces of the lumber when a leading end thereof becomes wedged within the first engaging means, said second engaging means preventing the lumber from twisting about a longitudinal axis as the lumber is pulled through the first engaging means.

15. A press machine, according to claim 14, further comprising:

a lateral support pivotally mounted to said frame, for rotatably supporting said first engaging means; and a control arm, slidably engaging said lateral support, and attached to said second engaging means, said control arm forcing said second engaging means against the lumber when said first engaging means receives the lumber.

16. A method for refurbishing a piece of lumber having foreign material projecting from at least one side thereof to form smooth sides on the lumber, said method comprising the steps of:

conveying a piece of lumber along a processing path;

slidably engaging upper and lower surfaces of the lumber to resist twisting of the lumber about a longitudinal axis thereof as the lumber moves along the processing path; and inducing continuous pressure upon opposite sides of the lumber simultaneously as the lumber passes through a pressing station to smooth said foreign material.

17. A method according to claim 16, wherein the engaging and inducing steps comprise the substeps of:

initially seizing opposite sides of a leading end of the lumber with a press member;

engaging top and bottom surfaces of the lumber to guide the lumber along a predefined path in a fixed orientation through the press member; and thereafter, driving the lumber through the press member.

* * * * *